US006299502B1

(12) United States Patent
Cheng

(10) Patent No.: US 6,299,502 B1
(45) Date of Patent: Oct. 9, 2001

(54) DEVICE FOR SCATTERING CONFETTI AND METHOD OF MAKING AND USING SAME

(76) Inventor: Peter Cheng, 99 Glencairn Street, Toronto, Ontario (CA), M4R 1M7

( * ) Notice: Subject to any disclaimer, the term of this patent is extended or adjusted under 35 U.S.C. 154(b) by 0 days.

(21) Appl. No.: 09/479,696

(22) Filed: Jan. 7, 2000

(51) Int. Cl.[7] ..... A63H 3/06

(52) U.S. Cl. ..... 446/224; 446/475; 446/183; 446/491

(58) Field of Search ..... 446/5, 220, 221, 446/222, 180, 183, 184, 475, 486, 487; 472/51, 52, 53

(56) References Cited

U.S. PATENT DOCUMENTS 1,567,973 * 12/1925 Mendelson .
5,205,773 * 4/1993 Koepcke et al. ..... 446/183
5,338,242 * 8/1994 Cheng ..... 446/220
5,433,644 * 7/1995 Cheng ..... 446/224
5,531,628 * 7/1996 Watkins ..... 446/475
5,601,472 * 2/1997 Parker ..... 446/475
5,975,983 * 11/1999 Panec ..... 446/475

* cited by examiner

*Primary Examiner*—Jacob K. Ackun, Jr.
*Assistant Examiner*—Jeffery D. Carlson
(74) *Attorney, Agent, or Firm*—Kirschstein, et al.

(57) ABSTRACT

A device for scattering confetti includes an inverted pocket positioned within the interior of an envelope inflated by a gas inlet at an upper end region of the envelope. Confetti is contained within the pocket, and a break-away closure closes an open end of the pocket at the upper end region, and maintains the confetti within the pocket. Upon compressing the envelope, the pocket is reversed in position, the closure ruptured, and the confetti is suddenly expelled in an explosive manner with a concomitant popping sound.

11 Claims, 3 Drawing Sheets

DEVICE FOR SCATTERING CONFETTI AND METHOD OF MAKING AND USING SAME

BACKGROUND OF THE INVENTION

1. Field of the Invention

The present invention generally relates to a device used on social and amusement occasions for scattering a multitude of objects and, more particularly, to a device for, and a method of, scattering confetti with an accompanying popping sound, as well as to a method of making the device.

2. Description of the Related Art

Upon social occasions, such as weddings or birthdays, or for purely amusement purposes, such as at carnivals, it is known to scatter confetti upwardly and forwardly into the air, over floors and tables, and over people, particularly the participants of the occasion being celebrated. Representative patents in this art include: U.S. Pat. No. 825,843 discloses a confetti cannon in which confetti and an explosive are mounted within a tube. Upon pulling a detonation string, the confetti is forcefully ejected. U.S. Pat. No. 1,560,326 discloses a confetti gun including a bag formed of two sheets of material sealed about their peripheries.

Confetti is placed within the bag. A discharge tube or neck extends to the bag. By forcefully squeezing and expanding the bag, the confetti is ejected. U.S. Pat. No. 4,932,915 discloses a balloon envelope into which confetti and other items are contained. After inflation, the balloon envelope is punctured, thereby causing the contents thereof to be ejected.

To more reliably scatter the confetti with an accompanying popping sound, I have previously disclosed in U.S. Pat. No. 5,338,242 and U.S. Pat. No. 5,433,643 confetti-scattering devices which, although highly satisfactory in operation, were not always effective in practice. My patented devices employed an inflatable envelope having a gas inlet and a confetti-filled pocket at opposite ends of the envelope. In the case where a user exhaled air into the inlet to inflate the envelope, the user held the envelope so that the inlet was at the top of the envelope for placement in one's mouth. This meant that the confetti-filled pocket was located at the bottom of the envelope.

After inflation, the user was instructed to tightly clench his or her fist around the inflated envelope to cause the air to expel the confetti from the pocket. The user was, of course, instructed to invert the envelope prior to clenching his or her fist. Failure to invert the envelope would cause the confetti to be expelled toward the floor or toward the user's body. Nevertheless, many users did not read or follow such instructions with the result that the confetti was not scattered upwardly and forwardly into the air as desired, but instead, was ejected rearwardly and downwardly in the opposite direction to that desired.

SUMMARY OF THE INVENTION

Objects of the Invention

Accordingly, it is a general object of this invention to provide a novel device for reliably upwardly and forwardly scattering multiple objects, e.g., confetti, into the air with an accompanying popping sound.

More particularly, it is an object of the present invention to eliminate the inversion of the device prior to scattering the confetti.

Still another object of the present invention is to provide a reliable, durable, yet inexpensive, device for forcefully ejecting confetti while reducing user error.

It is yet another object of the present invention to provide a novel method of making and using such an object-scattering device.

Features of the Invention

In keeping with the above objects and others which will become apparent hereinafter, one feature of the present invention resides, briefly stated, in a device for scattering objects, e.g, confetti, comprising an inflatable envelope having walls bounding an interior, and a gas inlet for admitting a pressurized gas, e.g., air, into the interior. The envelope extends between lower and upper end regions in an upright position of inflation in which the upper end region is elevated relative to the lower end region. The walls have inverted portions extending from the upper end region into the interior and bounding a pocket having an open end at the upper end region of the envelope. The gas inlet is provided at this upper end region.

A multitude of objects constituting the confetti is contained in the pocket. Break-away means are provided and extend across the open end. The break-away means is a closure operative for frangibly closing the pocket, and for rupturing upon compression of the inflated envelope in the upright position of inflation with a force sufficient to cause the gas to tear the closure, reverse the inverted portions, and expel the objects in an explosive manner with an accompanying popping sound.

Hence, in contrast with known devices where the gas inlet and the confetti-filled pocket are located at opposite ends of the envelope, the gas inlet and the confetti-filled pocket of the present invention are provided at the same end, that is, at the upper end region of the envelope. A user may now hold the envelope in the upright position, place his or her mouth on the gas inlet, and exhale air into the envelope to inflate the same. The user may next clench his or her hand tightly around the inflated envelope to rupture the envelope and expel the confetti without inverting the envelope as was required with my earlier patented devices. No longer need the user be compelled to follow directions instructing such inversion of the envelope. No longer will the confetti be inadvertently expelled toward the floor or back toward the user's body, but instead, the confetti will be reliably scattered upwardly and forwardly into the air away from the user's body.

In accordance with a preferred embodiment of this invention, the envelope includes a pair of sheets sealed together about their peripheries. The sheets may be constituted of a synthetic plastic material, paper, or a laminate. Preferably, the plastic sheets are heat-sealed together along their peripheries.

The envelope has side edge regions that linearly diverge as considered in a direction from the lower end region to the upper end region. The upper end region extends for a longer distance between the side edge regions as compared to the distance over which the lower end region extends between the side edge regions.

In the uninflated state, the upper, lower and side regions of the flattened envelope resemble a trapezoid. In the inflated state, the envelope assumes a frusto-conically shaped configuration resembling an ice cream cone. The inflated envelope thus easily fits in one's hand.

The confetti may include bits of colored paper, ribbon, rice, balls, toys, mini-figurines, candy, and, in short, virtually any toy or thing can be contained in the pocket.

In accordance with the preferred embodiment, the break-away means is an adhesive closure, preferably having score lines. Alternatively, the break-away means may be a low tensile strength paper or plastic strip adhered over the open end of the pocket.

The gas inlet includes a mouth tube or straw extending from the exterior of the envelope through the upper end region, and a chamber located within the pocket and in gaseous communication with the tube and with the interior of the envelope. Air exhaled into the tube by the user passes through the chamber into the envelope to inflate the same. Although the chamber and the tube are physically present in the pocket, no exhaled air enters the pocket. The air in the envelope cannot escape therefrom, because the walls of the chamber collapse and flatten against each other after air has passed therethrough and thereby prevent air from flowing back through the tube.

Another aspect of this invention relates to a method of making the aforementioned device. The method includes the following steps:

Initially, an inverted pocket having an open end is formed from an inflatable envelope. A gas inlet is positioned at the open end and is in gaseous communication with an interior of the envelope. Thereupon, the pocket is filled with the multitude of objects. Next, the pocket is frangibly closed by placing a break-away closure across the open end of the pocket.

In use, the envelope is held in one's hand, inflated by being so held, and compressed, again by being so held. The inflated envelope is never inverted. The inflating step is performed by having the user exhale into a gas inlet provided at the upper end region of the envelope. The frustoconical shape of the inflated envelope conveniently fits in one's hand and allows one's fingers to curl around the envelope.

Thus, in order to celebrate a social occasion such as New Year's Eve, one merely squeezes the inflated device in one's hand with a predetermined force sufficient to cause the gas therein to push against and reverse the inverted portions. This force tears the break-away closure and expels the confetti in an explosive manner with an accompanying popping sound, which also contributes to the festivities.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 2:
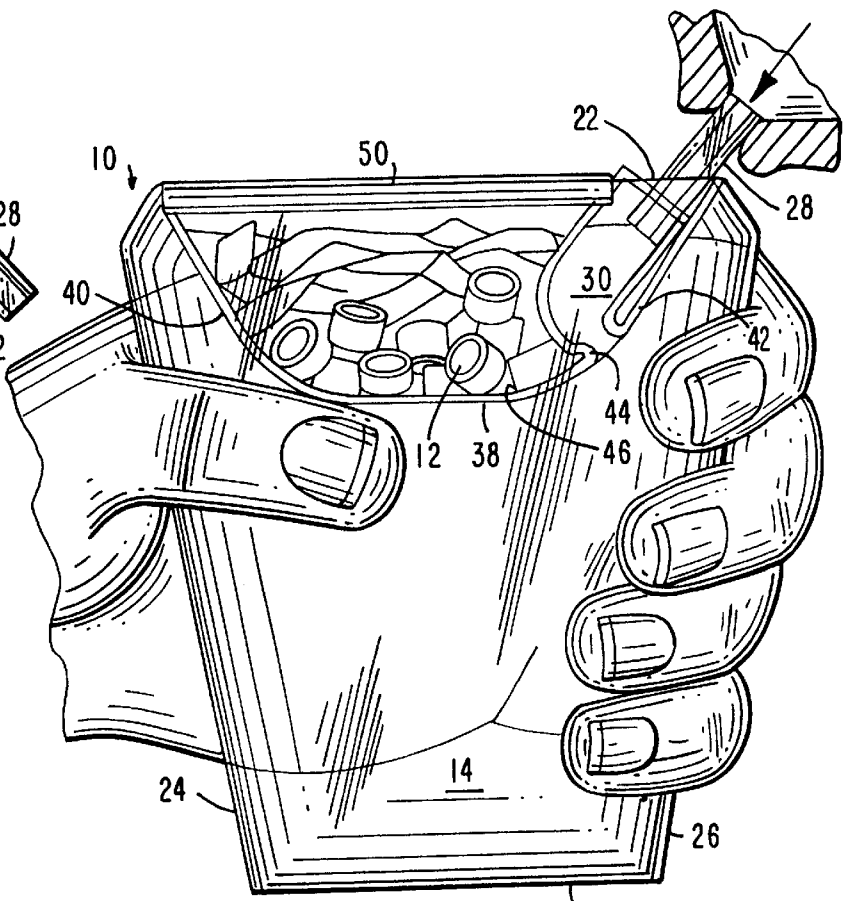
FIG. 2 is a view of the device of FIG. 1 after manufacture.

Referring now to the drawings, reference numeral 10 generally identifies a device for scattering a multitude of objects 12 in accordance with this invention. Device 10 includes an inflatable envelope having an upper flexible sheet 14 and a lower flexible sheet 16 overlying each other and sealed about their peripheral overlapping edges to bound an interior 18. The flexible sheets 14, 16 may be constituted of paper, plastic, or a plastic-metal laminate, such as aluminum coated over Mylar™. Preferably, the sheets 14, 16 are heat-fused and sealed about their peripheral edges. Alternatively, a single sheet can be employed and folded over to form one or more of the peripheral edges.

Figure 1:
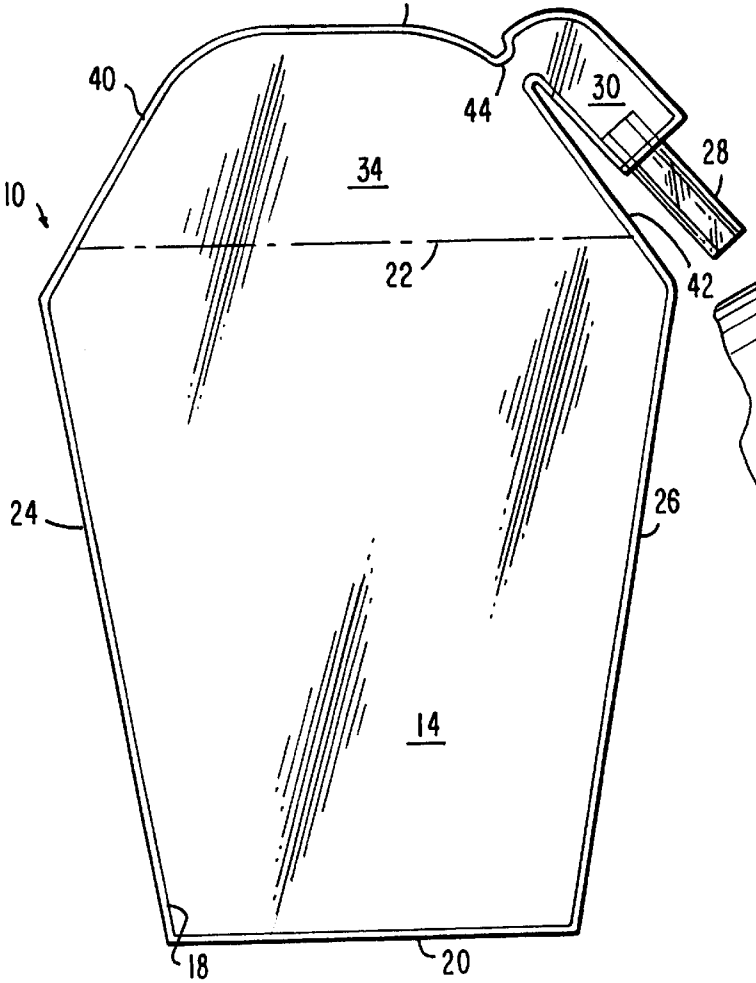
FIG. 1 is a front view of a device in accordance with this invention during its manufacture.
Figure 3:
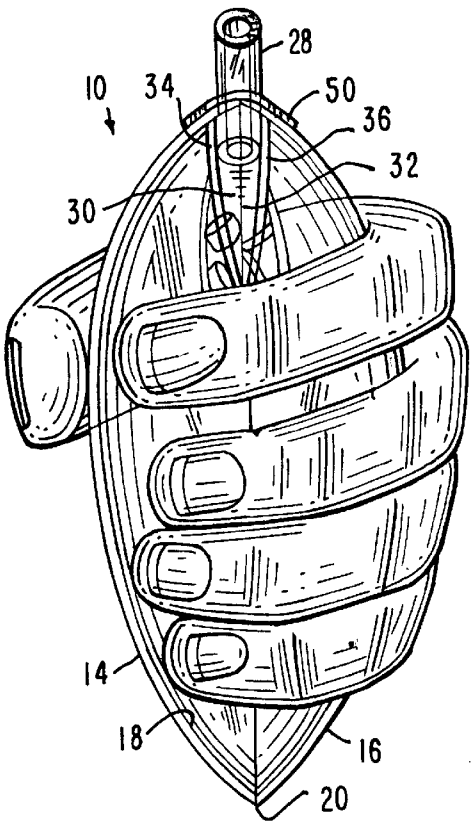
FIG. 3 is a side view of the inflated device of FIG. 2.

As shown in FIG. 1, the envelope in an initial stage of manufacture has a lower end region 20, an upper end region 22, and a pair of side edge regions 24, 26 linearly diverging upwardly as considered in a direction from the lower to the upper end region. Lower region 20 is linear and extends generally parallel to, and for a shorter transverse distance as compared to, upper region 22.

A gas inlet extends from the exterior into the interior 18 of the envelope. The inlet includes a mouth tube 28, and a pair of chamber walls 30, 32 in gaseous communication with the tube 28 and the interior 18 of the envelope. The chamber walls are sealed around an inner end of the tube.

As shown in FIG. 1, pocket portions 34, 36 are formed as continuations of the walls 14, 16, respectively. The pocket portions are joined together along upper pocket edge 38, and along side pocket edges 40, 42 which are continuations of the side edge regions 24, 26, respectively. The side pocket edges converge in a direction from the upper end region 22 toward the upper pocket edge 38. The pocket portions 34, 36 and the walls 14, 16 together bound the interior 18. The only break in the interior is an aperture 44 which enables gas to flow between the chamber 30 and the interior 18.

Figure 5:
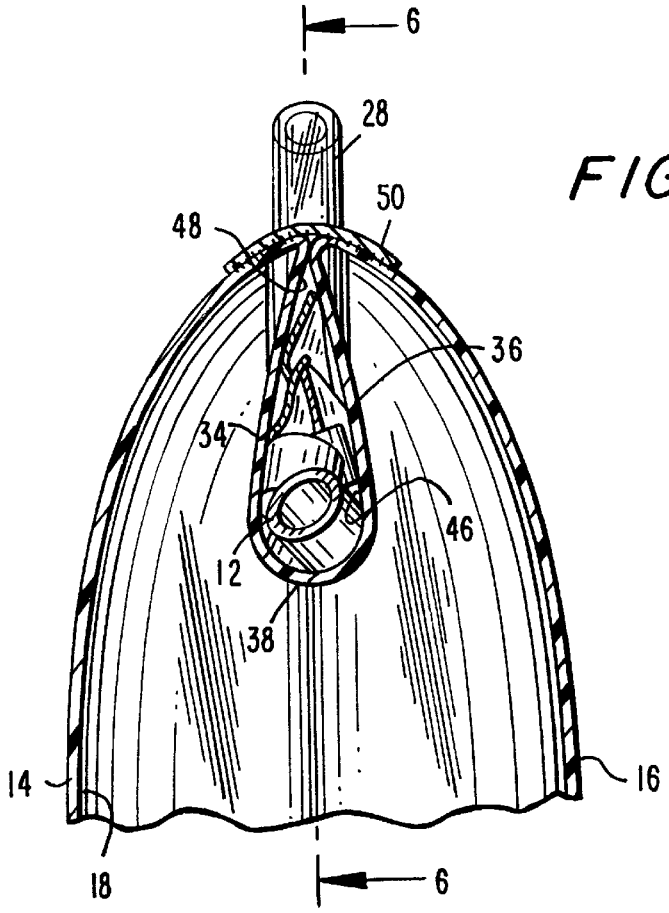
FIG. 5 is an enlarged, broken-away, sectional view of the inlet region of the device of FIG. 2.
Figure 6:
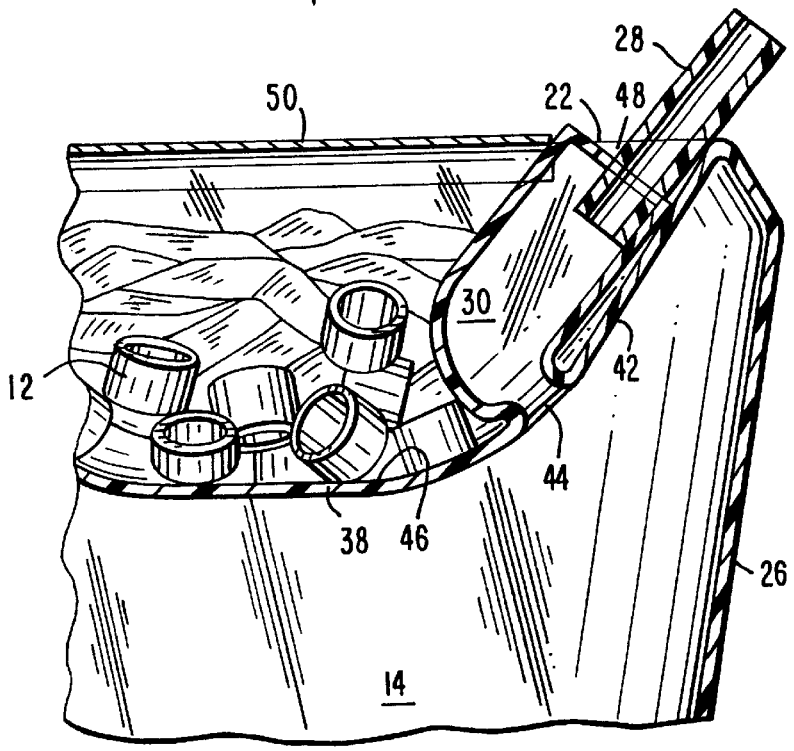
FIG. 6 is a sectional view taken on line 6—6 of FIG. 5.

The pocket portions 34, 36 depicted in FIG. 1 are inverted and pushed back into the interior 18 of the envelope, thereby forming a pocket 46 (see FIG. 5) having an open end 48. The objects 12 are placed within the pocket. The objects 12 include bits of paper and ribbon, both colored and non-colored, both flat and three-dimensional, as well as other items such as rice, candy, toys, and the like and, in short, virtually anything generally regarded as confetti can be used. The open end 48 of the pocket is situated at the same elevation as the upper end region 22 in FIG. 2.

As shown in FIG. 2, the chamber walls 30, 32 and at least a lower, inner end of the tube 28 are situated within the pocket 46. The tube extends outwardly of the open end 48 of the pocket and of the upper end region 22 of the envelope. A user can place his or her lips (see FIG. 2) on an upper, outer end of the tube 28 and exhale air through the tube 28, the chamber 30, 32, the aperture 44, and into the interior 18 of the envelope to inflate the same. No exhaled air inflates the pocket 46 since the pocket is sealed off from the air flow. No air within the envelope escapes back through the aperture 44, because the walls 30, 32 of the chamber collapse together in a self-sealing action operative like a one-way check valve.

A break-away closure 50 is positioned on the envelope in overlapping relationship with the pocket 46 to overlie and close the open end 48 of the pocket. The closure 50 is a low tensile strength tissue paper or plastic strip adhered to the envelope. Preferably, the adhesive is a pressure-sensitive adhesive.

Figure 4:
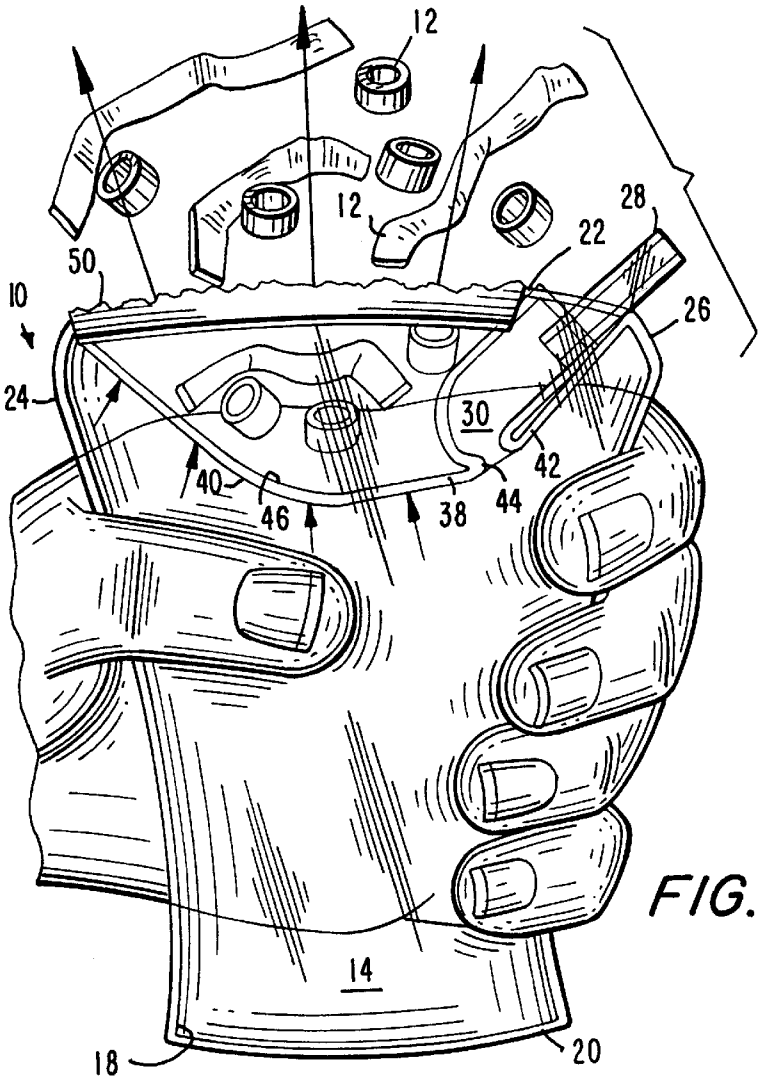
FIG. 4 is a view of the inflated device in use.

In order to scatter the confetti 12, a user, as illustrated in FIG. 4, squeezes the inflated envelope between one's fingers by clenching one's fingers to form a fist. The gas within the envelope is forced to the inverted pocket walls 34, 36 in a direction tending to reverse their inverted position. That is to say, the pocket 46 is forced out through its end 48. When the pressure within the envelope reaches a predetermined amount, the closure 50 ruptures, and the confetti 12 is suddenly expelled with a concomitant popping sound.

The inflated envelope is wider at the top and narrower at its bottom to enable the user to curl his or her fingers of one hand comfortably around the envelope. When the user first picks up the envelope, it is natural for the user to hold the envelope such that the wider top is elevated above the narrower bottom. The placement of the tube at the top further encourages the user to hold the envelope in this upright position so that the user's lips can conveniently contact the tube.

Thereupon, it is natural for the user to clench his or her fingers into a fist to expel the confetti. No instructions need be followed regarding inverting the envelope before such clenching occurs. Use of the device is therefore intuitive.

It will be understood that each of the elements described above, or two or more together, also may find a useful application in other types of constructions differing from the types described above.

While the invention has been illustrated and described as embodied in a device for scattering a multitude of objects and methods of making and using same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A device for scattering confetti, comprising:

a) an inflatable envelope having walls bounding an interior and extending between a lower end region and an upper end region in an upright position of inflation, the walls having inverted portions extending from the upper end region into the interior and bounding a pocket having an open end at the upper end region of the envelope;

b) a gas inlet including chamber walls bounding a chamber within the pocket, for admitting a pressurized gas from an exterior of the envelope through the chamber into the interior of the envelope to inflate the envelope in the upright position of inflation, the chamber walls sealingly engaging each other to prevent the gas from flowing toward the exterior of the envelope after inflation;

c) a multitude of objects constituting the confetti contained in the pocket; and d) a break-away closure extending across the open end, for frangibly closing the pocket, and for rupturing upon compression of the inflated envelope in the upright position of inflation with a force sufficient to cause the gas to tear the closure, reverse the inverted portions, and expel the confetti in an explosive manner with an accompanying popping sound.

2. The device according to claim 1, wherein the envelope has side edge regions that diverge as considered in a direction from the lower end region toward the upper end region.

3. The device according to claim 2, wherein the side edge regions diverge along linear courses in an uninflated condition of the envelope.

4. The device according to claim 2, wherein the side edge regions are spaced apart along a transverse direction, wherein the lower and upper end regions extend along the transverse direction, and wherein the upper end region extends along the transverse direction for a longer distance than the lower end region.

5. The device according to claim 2, wherein the envelope has a pair of synthetic plastic sheets connected together along the side edge regions and along the lower end region.

6. The device according to claim 1, wherein the gas inlet includes a mouth tube extending from the exterior of the envelope through the upper end region of the envelope.

7. The device according to claim 6, wherein the tube is in gaseous communication with the chamber, and wherein the chamber is in gaseous communication with the interior of the envelope.

8. The device according to claim 1, wherein the closure is an adhesive strip.

9. A method of making a device for scattering confetti, comprising the steps of:

a) forming an inverted pocket having an open end from an inflatable envelope;

b) positioning a gas inlet at the open end of the pocket and in gaseous communication with an interior of the envelope;

c) filling the pocket with a multitude of objects constituting the confetti; and d) frangibly closing the pocket by positioning a break-away closure across the open end of the pocket.

10. A method of using a device for scattering a confetti, comprising the steps of:

a) holding in one's hand an inflatable envelope of the device having upper and lower end regions in an upright position in which the upper end region is elevated relative to the lower end region, the envelope having inverted wall portions extending from the upper end region into an interior of the envelope and bounding a pocket containing confetti, the pocket having at the upper end region an open end that is frangibly closed by a break-away closure;

b) inflating the envelope while holding the envelope in the upright position in said one hand by admitting a pressurized gas through a gas inlet from an exterior of the envelope through a chamber located within the pocket and into the interior of the envelope, the chamber having walls that sealingly engage each other to prevent the gas from flowing toward the exterior of the envelope after the inflating step; and c) compressing the inflated envelope in the upright position by clenching said one hand into a fist with a force sufficient to cause the gas to rupture the closure, to reverse the inverted portions, and to expel the confetti in an explosive manner with an accompanying popping sound.

11. The method of claim 10, wherein the inflating step is performed by exhaling air into the inlet.

* * * * *